US011142423B2

(12) United States Patent
Kotani

(10) Patent No.: US 11,142,423 B2
(45) Date of Patent: Oct. 12, 2021

(54) SHEET STACKING DEVICE, SHEET POST PROCESSING DEVICE, AND IMAGE FORMING SYSTEM

(71) Applicant: KYOCERA Document Solutions Inc., Osaka (JP)

(72) Inventor: Takashi Kotani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 32 days.

(21) Appl. No.: 16/854,116

(22) Filed: Apr. 21, 2020

(65) Prior Publication Data

US 2020/0339370 A1 Oct. 29, 2020

(30) Foreign Application Priority Data

Apr. 23, 2019 (JP) ..... JP2019-081691

(51) Int. Cl.
*B65H 29/22* (2006.01)
*B65H 37/00* (2006.01)
*B65H 31/26* (2006.01)

(52) U.S. Cl.
CPC ..... *B65H 29/22* (2013.01); *B65H 37/00* (2013.01); *B65H 31/26* (2013.01); *B65H 2404/693* (2013.01)

(58) Field of Classification Search
CPC ..... B65H 2404/70; B65H 2404/257; B65H 2404/693; B65H 2404/661; B65H 2404/1413
See application file for complete search history.

(56) References Cited

U.S. PATENT DOCUMENTS 7,673,867 B2 * 3/2010 Keny ..... G03G 15/6538 270/58.12
2004/0201165 A1 * 10/2004 Kamiya ..... B65H 31/26 271/220
2006/0208411 A1 * 9/2006 Saito ..... B65H 31/36 270/58.07
2007/0063427 A1 * 3/2007 Hong ..... B65H 31/36 271/220
2007/0284809 A1 * 12/2007 Murata ..... B65H 29/34 271/221

FOREIGN PATENT DOCUMENTS

JP 2008-7207 A 1/2008
JP 2013-82550 A 5/2013

* cited by examiner

*Primary Examiner* — Jennifer Bahls
(74) *Attorney, Agent, or Firm* — Stein IP, LLC

(57) ABSTRACT

A sheet stacking device includes a sheet outlet, a lower discharge roller, and a paddle member. The paddle member is disposed coaxially to a rotation shaft of the lower discharge roller, and is driven to rotate independently of the lower discharge roller in the same direction as the lower discharge roller, so as to contact downward an upstream part in a discharging direction of a sheet discharged through the sheet outlet. The paddle member includes a base part in which the rotation shaft is inserted, an arm part protruding in a direction separating from an axis center of the base part, and a paddle elastic part protruding from the arm part. A rotation speed of the paddle member is the same as a rotation speed of a discharge roller pair when the sheet passes through a nip of the discharge roller pair.

7 Claims, 13 Drawing Sheets

SHEET STACKING DEVICE, SHEET POST PROCESSING DEVICE, AND IMAGE FORMING SYSTEM

INCORPORATION BY REFERENCE

This application is based upon and claims the benefit of priority from the corresponding Japanese Patent Application No. 2019-081691 filed Apr. 23, 2019, the entire contents of which are hereby incorporated by reference.

BACKGROUND

The present disclosure relates to a sheet stacking device, a sheet post-processing device including the sheet stacking device, and an image forming system including the sheet post-processing device.

There is known a sheet post-processing device including a post-processing mechanism that performs a post-processing such as a stapling process or a punching process on a sheet on which an image has been formed. The sheet post-processing device is equipped with a sheet stacking device including a discharge roller pair that discharges the sheet to which the post-processing has been applied is performed, and a stacking tray for stacking the sheet discharged by the discharge roller pair. As the sheet stacking device, there is known a device that taps an upstream part (a rear end part) in a discharging direction of the sheet that has passed through a nip of the discharge roller pair so that the sheet falls on the stacking tray, and presses the rear end part of the sheet that has fallen on the stacking tray.

A first conventional sheet discharging device includes a pressing member that can rotate about a rotation shaft disposed below a rotation shaft of a sheet discharge roller (discharge roller pair). The pressing member and the sheet discharge roller are driven to rotate respectively by a pressing member drive motor and a sheet discharge drive motor, which are separate bodies. The pressing member is driven to rotate by a driving force from the pressing member drive motor, so as to press a rear end part in the discharging direction of a sheet that has passed through the sheet discharge roller, in a tapping manner from above.

A second conventional sheet discharging device includes a scraping member, which is disposed coaxially to a driven discharge roller out of a discharge roller pair and is driven to rotate by a sheet discharged by the discharge roller pair. The scraping member includes a plurality of flexible blade members protruding from an outer circumferential surface. The blade members scrape a rear end part of the sheet that has passed through the discharge roller pair and further press the rear end part of the sheet stacked on the stacking tray.

SUMMARY

A sheet stacking device according to one aspect of the present disclosure includes a discharge roller pair, a sheet outlet, a stacking tray, and a paddle member. The discharge roller pair includes a lower discharge roller and an upper discharge roller, whose circumferential surfaces contact each other so as to form a nip, and discharges a sheet in a predetermined discharging direction. The sheet outlet is provided with a discharge roller pair. The stacking tray is disposed below a downstream side of the sheet outlet in a sheet discharging direction, and the sheet discharged through the sheet outlet by the discharge roller pair is stacked on the stacking tray. The paddle member is disposed coaxially to a rotation shaft of the lower discharge roller and is driven to rotate about an axis of the rotation shaft of the lower discharge roller independently of the lower discharge roller in the same direction as the lower discharge roller, so as to contact the sheet discharged through the sheet outlet at an upstream part in the discharging direction from above. The paddle member includes a base part, an arm part, and a paddle elastic part. The rotation shaft is inserted in the base part. The arm part protrudes from the base part in a direction crossing the axis and separating from an axis center. The paddle elastic part is attached to the arm part and protrudes from the arm part. A rotation speed of the discharge roller pair is decreased before the sheet passes through the nip of the discharge roller pair. The paddle member waits at a predetermined position and starts to rotate before the sheet passes through the nip of the discharge roller pair so that the sheet is stacked on the stacking tray. A rotation speed of the paddle member is the same as the rotation speed of the discharge roller pair when the sheet passes through the nip of the discharge roller pair.

DETAILED DESCRIPTION

Hereinafter, embodiments of the present disclosure are described with reference to the drawings. Note that the present disclosure is not limited to the contents of the following description.

Figure 1:
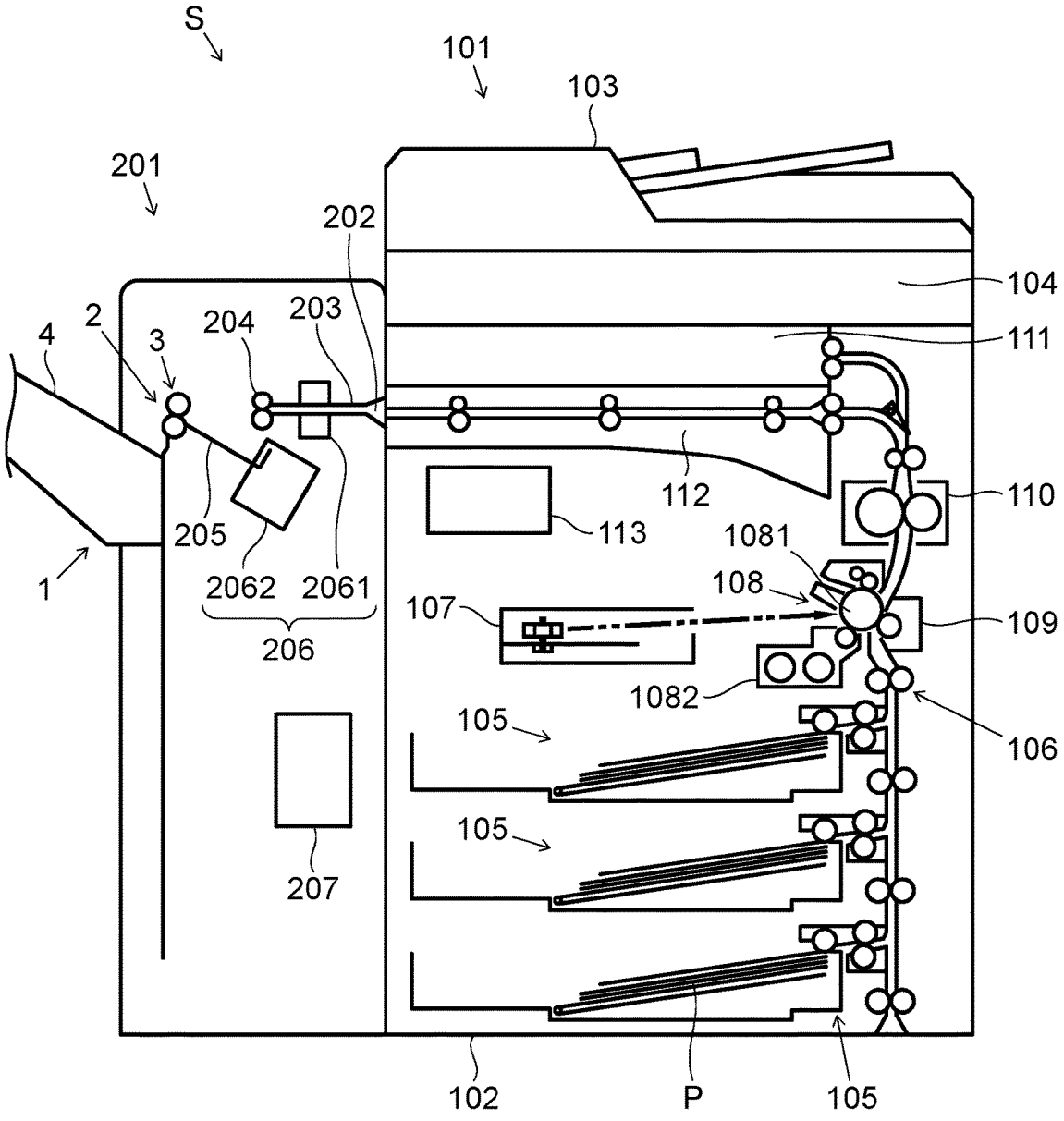
FIG. 1 is a cross-sectional front view illustrating a schematic structure of an image forming system according to a first embodiment of the present disclosure.

FIG. 1 is a cross-sectional front view illustrating a schematic structure of an image forming system S according to a first embodiment. The image forming system S includes an image forming apparatus 101 and a sheet post-processing device 201.

The image forming apparatus 101 is a so-called multifunction peripheral of a monochrome type having functions such as printing, scanning (image reading), and facsimile sending. Note that the image forming apparatus 101 may be an apparatus such as a copier or a printer, and may be an apparatus supporting color processing.

As illustrated in FIG. 1, the image forming apparatus 101 includes its main body 102, a document feeder unit 103 disposed on the upper surface of the main body 102, and an image reader unit 104 disposed below the document feeder unit 103 and inside the main body 102. An image of a document placed on the document feeder unit 103 or an image of a document placed on a contact glass (not shown) of the upper surface of the image reader unit 104 is read by the image reader unit 104.

The image forming apparatus 101 further includes a sheet supply unit 105, a sheet conveying unit 106, an exposing unit 107, an image forming unit 108, a transferring unit 109, a fixing unit 110, a sheet discharge unit 111, a relaying unit 112, and a main body control unit 113.

The sheet supply unit 105 stores a plurality of sheets P, and separates and sends out sheets P one by one when printing is performed. The sheet conveying unit 106 conveys the sheet P sent out from the sheet supply unit 105 to the transferring unit 109 and the fixing unit 110, and further sends the sheet P after fixing to the sheet discharge unit 111 or to the relaying unit 112. The exposing unit 107 emits a laser beam controlled based on image data toward the image forming unit 108.

The image forming unit 108 includes a photosensitive drum 1081 that is an image carrier, and a developing device 1082. In the image forming unit 108, the laser beam emitted from the exposing unit 107 forms an electrostatic latent image of a document image on the surface of the photosensitive drum 1081. The developing device 1082 supplies toner to this electrostatic latent image so as to develop the same, and forms a toner image. The transferring unit 109 transfers the toner image on the surface of the photosensitive drum 1081 formed by the image forming unit 108 to the sheet P. The fixing unit 110 heats and presses the sheet P to which the toner image is transferred, so that the toner image is fixed to the sheet P.

The sheet P after fixing is conveyed to the sheet discharge unit 111 or to the relaying unit 112. The sheet discharge unit 111 is disposed below the image reader unit 104. The sheet discharge unit 111 has an opening on the front, and the sheet after printing (printed matter) is taken out from the front side. The relaying unit 112 is disposed below the sheet discharge unit 111. A downstream end of the relaying unit 112 in the sheet conveying direction is connected to the sheet post-processing device 201. The sheet after printing (printed matter) sent to the relaying unit 112 passes through inside of the relaying unit 112 and is conveyed to the sheet post-processing device 201.

The main body control unit 113 includes a CPU, an image processing unit, and a storage unit, which are not shown, and further includes other electronic circuits and electronic components, which are not shown. The CPU controls operations of individual structural elements disposed in the image forming apparatus 101 based on a control program and data stored in the storage unit, so as to perform processes related to functions of the image forming apparatus 101. Each of the sheet supply unit 105, the sheet conveying unit 106, the exposing unit 107, the image forming unit 108, the transferring unit 109, and the fixing unit 110 individually receives a command from the main body control unit 113, and they work together so as to perform printing on the sheet P. The storage unit is constituted of a combination of a nonvolatile storage device such as a program read only memory (ROM) and a data ROM and a volatile storage device such as a random access memory (RAM), which are not shown.

The sheet post-processing device 201 is connected to a side surface of the image forming apparatus 101 in a detachable manner. Note that the sheet post-processing device 201 can be connected also to an apparatus such as a copier or a printer other than the multifunction peripheral in the same manner. As illustrated in FIG. 1, the sheet post-processing device 201 includes a sheet entrance 202, a sheet discharge passage 203, an intermediate roller pair 204, a process tray 205, a post-processing unit 206, a sheet stacking device 1, and a post-processing control unit 207.

The sheet entrance 202 is formed and opened on a side surface opposed to the relaying unit 112 of the image forming apparatus 101. The sheet P that has passed through the relaying unit 112 passes the sheet entrance 202 and is conveyed to the inside of the sheet post-processing device 201.

The sheet discharge passage 203 extends from the sheet entrance 202 to above the process tray 205 laterally in a direction separating from the image forming apparatus 101 (in the left direction in FIG. 1).

The intermediate roller pair 204 is disposed in the sheet discharge passage 203 on the downstream side of a punching unit 2061 described later in the sheet discharging direction. A rotation shaft of the intermediate roller pair 204 extends in a sheet width direction (direction perpendicular to paper of FIG. 1) perpendicular to the sheet discharging direction. A plurality of the intermediate roller pairs 204 are disposed with spaces in the sheet width direction. The intermediate roller pairs 204 send the sheet P conveyed in the sheet discharge passage 203 to a sheet outlet 2 described later, on the further downstream side.

The process tray 205 is disposed below a downstream part of the sheet discharge passage 203 in the sheet discharging direction. In other words, the process tray 205 is disposed immediately below the downstream side of the intermediate roller pair 204 in the sheet discharging direction. The sheet placing surface of the process tray 205 has a slope inclined upward toward the downstream side in the sheet discharging direction. The plurality of sheets P conveyed to the process tray 205 through the sheet discharge passage 203 are placed on the process tray 205, and post-processing is performed on them.

The post-processing unit 206 performs a predetermined post-processing on the sheet P conveyed through the sheet discharge passage 203. The post-processing unit 206 includes the punching unit 2061 and a stapling unit 2062.

The punching unit 2061 is disposed at an intermediate part between the sheet entrance 202 as an upstream end and a downstream end of the sheet discharge passage 203 in the sheet discharging direction. The sheet post-processing device 201 uses the punching unit 2061 for performing a punching process on the sheet P conveyed through the sheet discharge passage 203, so that punch holes can be formed.

The stapling unit 2062 is disposed on the upstream side of the process tray 205 in the sheet discharging direction. The sheet post-processing device 201 uses the stapling unit 2062 for performing a stapling process (binding process) on the sheets P placed on the process tray 205, so that the sheets can be bound.

The sheet stacking device 1 is disposed on the downstream side of the process tray 205 in the sheet discharging direction. The sheet stacking device 1 includes a discharge roller pair 3, and a stacking tray 4. The discharge roller pair 3 is disposed on the downstream end of the process tray 205 in the sheet discharging direction. The stacking tray 4 is disposed on the downstream side of the discharge roller pair 3 in the sheet discharging direction. The sheets P after the post-processing is finished on the process tray 205 are discharged by the discharge roller pair 3 onto the stacking tray 4 and are taken out. Note that if the post-processing by the stapling unit 2062 is not performed, the sheet P is conveyed to the stacking tray 4 without being placed on the process tray 205. The detailed structure of the sheet stacking device 1 will be described later.

The post-processing control unit 207 includes a CPU and a storage unit, which are not shown, and further includes other electronic circuits and electronic components, which are not shown. The post-processing control unit 207 is connected to the main body control unit 113 in a communicable manner. The post-processing control unit 207 receives a command from the main body control unit 113, and controls operations of individual structural elements of the sheet post-processing device 201 using the CPU on the basis of a control program and data stored in the storage unit, so as to perform a process related to the function of the sheet post-processing device 201. Each of the sheet discharge passage 203, the intermediate roller pair 204, the process tray 205, the post-processing unit 206, and the sheet stacking device 1 individually receives a command from the post-processing control unit 207, and they work together so as to perform post-processing on the sheets P. The storage unit is constituted of, for example, a combination of storage devices such as a program ROM, a data ROM, and a RAM, which are not shown.

Figure 2:
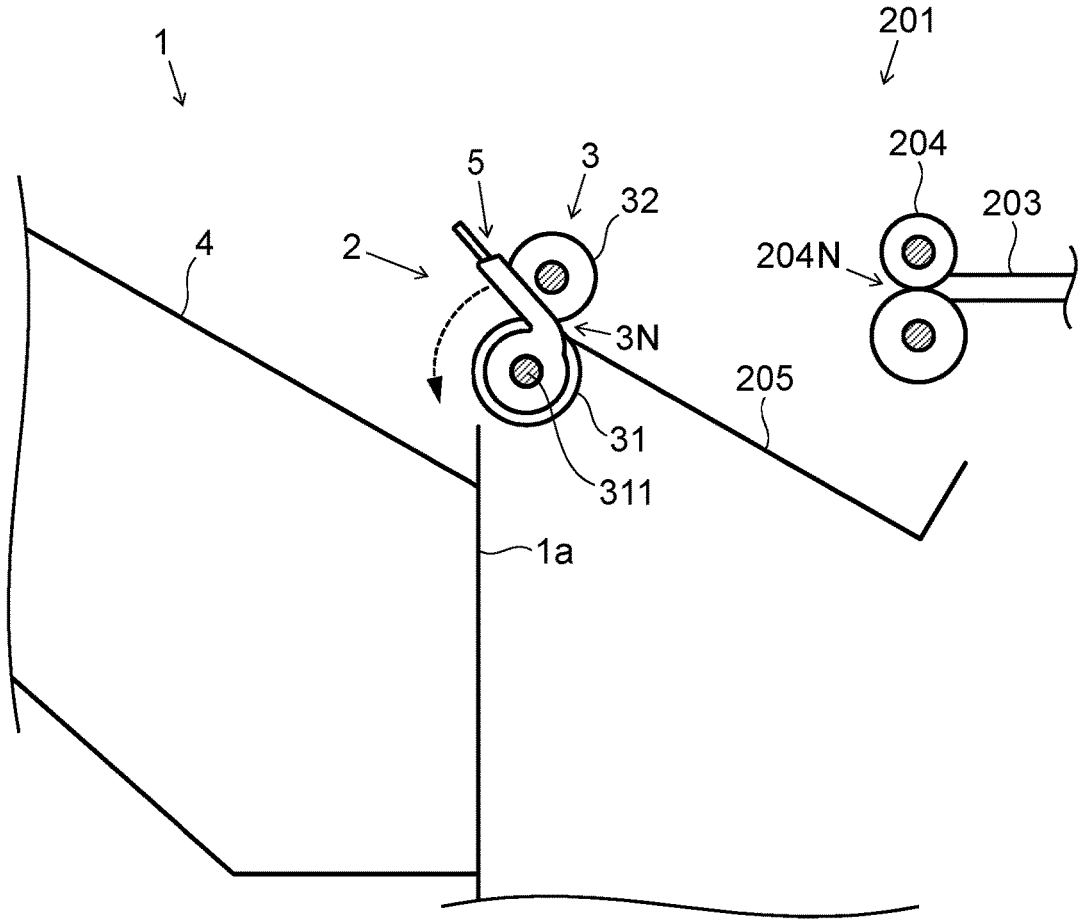
FIG. 2 is a cross-sectional front view illustrating a schematic structure of a sheet post-processing device according to a first embodiment of the present disclosure.
Figure 3:
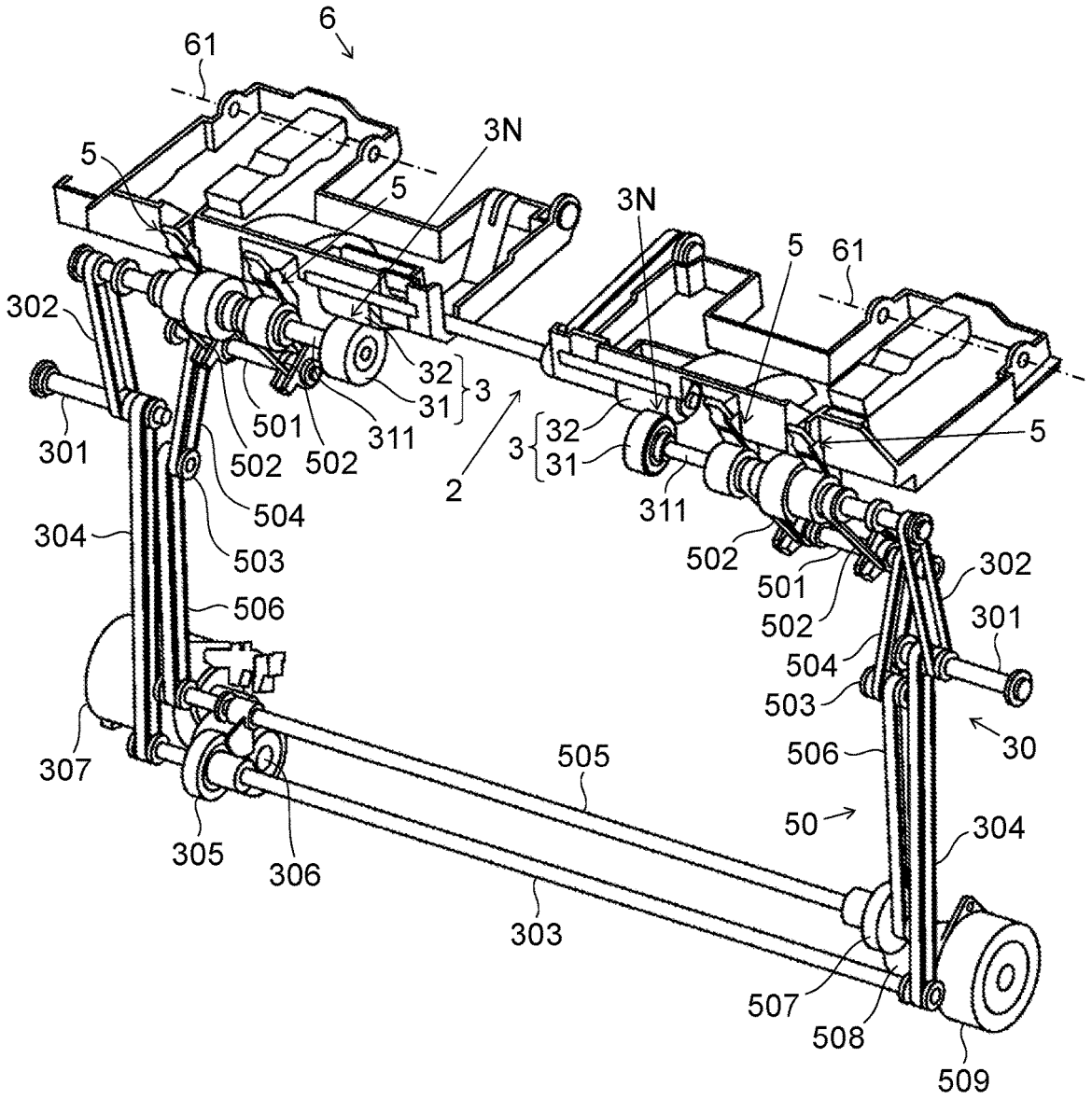
FIG. 3 is a perspective view illustrating a drive system of a sheet stacking device according to a first embodiment of the present disclosure.
Figure 4:
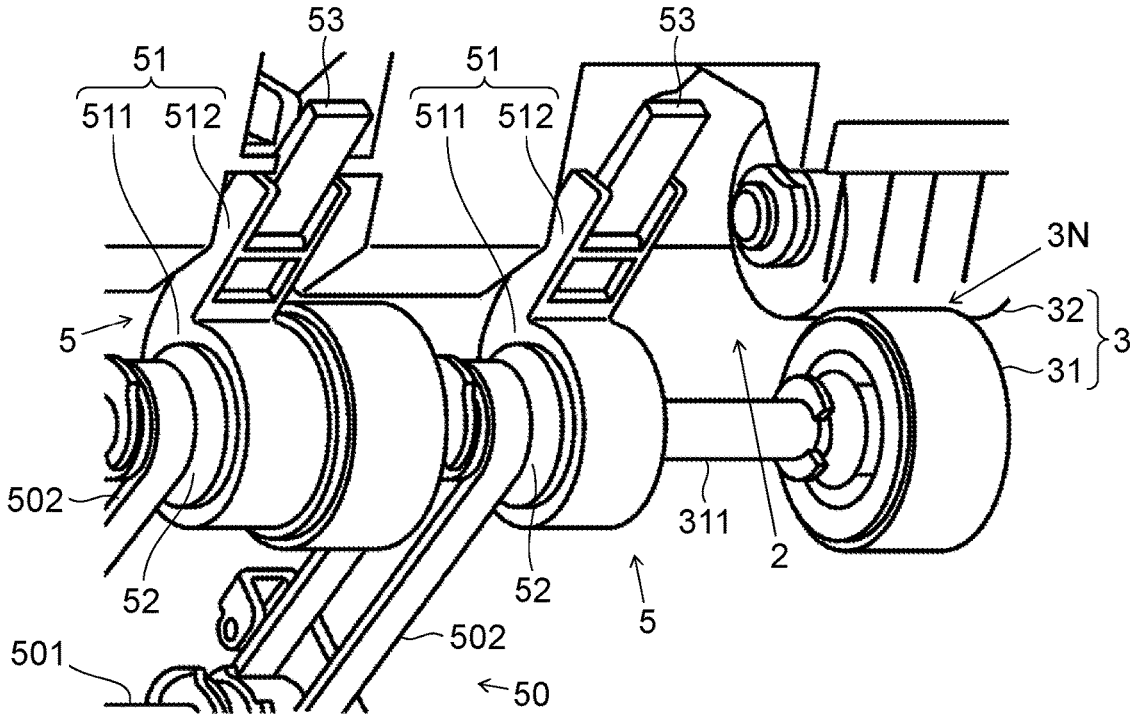
FIG. 4 is a partial perspective view illustrating a sheet outlet and its vicinity of the sheet stacking device according to the first embodiment of the present disclosure.

Next, a detailed structure of the sheet stacking device 1 is described with reference to FIGS. 2, 3, and 4. FIG. 2 is a cross-sectional front view illustrating a schematic structure of the sheet post-processing device 201. FIG. 3 is a perspective view illustrating a drive system of the sheet stacking device 1. FIG. 4 is a partial perspective view illustrating the sheet outlet 2 and its vicinity of the sheet stacking device 1.

As illustrated in FIG. 2, the sheet stacking device 1 includes the sheet outlet 2, the discharge roller pair 3, the stacking tray 4, and a paddle member 5. Further, as illustrated in FIG. 3, the sheet stacking device 1 includes a support part 6, a discharge drive unit 30, and a paddle drive unit 50.

The sheet outlet 2 is disposed on the downstream side of the intermediate roller pair 204 in the sheet discharging direction and on the downstream side of the process tray 205 in the sheet discharging direction. The sheet outlet 2 is provided with the discharge roller pair 3. The sheets P after post-processing is finished on the process tray 205 are discharged through the sheet outlet 2 onto the stacking tray 4.

The discharge roller pair 3 is disposed at the sheet outlet 2. The rotation shaft of the discharge roller pair 3 extends in the sheet width direction (direction perpendicular to paper of FIG. 2). A plurality of the discharge roller pairs 3 are disposed with spaces in the sheet width direction. In this embodiment, two discharge roller pairs 3 are disposed. Each of the two discharge roller pairs 3 includes a lower discharge roller 31 and an upper discharge roller 32.

The lower discharge roller 31 is connected to the discharge drive unit 30, and it can rotate forward for discharging the sheet P onto the stacking tray 4 or backward for sending the sheet P onto the process tray 205. The upper discharge roller 32 contacts the lower discharge roller 31 and is driven to rotate by the same. The detailed structure of the discharge drive unit 30 will be described later.

The upper discharge roller 32 is supported by the support part 6 illustrated in FIG. 3. The support part 6 extends in the sheet discharging direction, and it supports the upper discharge roller 32 in a rotatable manner at one end on the downstream end side in the sheet discharging direction.

The support part 6 is supported by the sheet post-processing device 201 in a rotatable manner about a rotation axis 61 extending in the sheet width direction at one end on the upstream end side in the sheet discharging direction. The support part 6 is connected to a drive unit (not shown), and is rocked about the rotation axis 61, in the up and down direction at one end supporting the upper discharge roller 32 as a free end. This rocking of the support part 6 allows the upper discharge roller 32 to contact or separate from the lower discharge roller 31. As illustrated in FIGS. 2, 3, and 4, circumferential surfaces of the upper discharge roller 32 and the lower discharge roller 31 contact each other so as to form a nip 3N for discharging the sheets P through the sheet outlet 2. The rocking of the support part 6 is controlled by the post-processing control unit 207.

The sheet P discharged through the sheet outlet 2 by forward rotation of the discharge roller pair 3 is stacked on the stacking tray 4. In addition, in a state where the nip 3N of the discharge roller pair 3 holds the sheet P and the upstream end of the sheet P in the discharging direction is separated from a nip 204N of the intermediate roller pair 204, when the discharge roller pair 3 is rotated backward, the sheet P is conveyed onto the process tray 205.

The stacking tray 4 is disposed below the downstream side of the sheet outlet 2 in the sheet discharging direction. A sheet stacking surface of the stacking tray 4 has a slope inclined upward toward the downstream side in the sheet discharging direction. The downstream end of the stacking tray 4 in the sheet discharging direction is disposed below the sheet outlet 2. A sheet receiving wall 1*a* is disposed on the upstream side of the stacking tray 4 in the sheet discharging direction. The sheet receiving wall 1*a* extends upward from an upstream side end of the stacking tray 4 in the sheet discharging direction to the sheet outlet 2. The sheet P discharged through the sheet outlet 2 by the discharge roller pair 3 is stacked on the stacking tray 4. The stacking tray 4 is a final discharge place for the sheets P in the sheet post-processing device 201.

The paddle member 5 is disposed coaxially to the discharge roller pair 3. Describing in detail, the paddle member 5 is disposed coaxially to a rotation shaft 311 ("rotation shaft" in claim 1) of the lower discharge roller 31. Describing in more detail, in this embodiment, there are disposed total four paddle members 5, i.e. two paddle members 5 coaxially to each of the two rotation shafts 311 of the two lower discharge rollers 31. Note that the rotation shafts 311 extend in the sheet width direction.

The two lower discharge rollers 31 are simultaneously driven to rotate by the discharge drive unit 30. As illustrated in FIG. 3, the discharge drive unit 30 includes a drive transmission shaft 301, a first drive transmission belt 302, a drive shaft 303, a second drive transmission belt 304, a drive transmission gear 305, a drive gear 306, and a drive motor 307.

There are disposed two sets of the drive transmission shaft 301, the first drive transmission belt 302 and the second drive transmission belt 304 corresponding to two rotation shafts 311 of the two lower discharge rollers 31. There is disposed one set of the drive shaft 303, the drive transmission gear 305, the drive gear 306, and the drive motor 307.

The drive transmission shaft 301 is disposed below the rotation shaft 311 of the lower discharge roller 31. The drive transmission shaft 301 extends in the sheet width direction.

The first drive transmission belt 302 is stretched over pulleys of the rotation shaft 311 of the lower discharge roller 31 and the drive transmission shaft 301. The first drive transmission belt 302 transmits a rotational force of the drive transmission shaft 301 to the rotation shaft 311.

The drive shaft 303 is disposed below the drive transmission shafts 301. The drive shaft 303 extends in the sheet width direction.

The second drive transmission belt 304 is stretched over pulleys of the drive transmission shaft 301 and the drive shaft 303. Describing in detail, the two second drive transmission belts 304 are stretched over the single drive shaft 303, and each of the second drive transmission belts 304 is stretched over each of the separate drive transmission shafts 301, respectively. The second drive transmission belt 304 transmits a rotational force of the drive shaft 303 to the drive transmission shaft 301.

The drive transmission gear 305 is provided to the drive shaft 303. The drive transmission gear 305 is disposed coaxially to the drive shaft 303 and rotates together with the drive shaft 303.

The drive gear 306 is provided to a rotation shaft of the drive motor 307. The drive gear 306 is rotated by the drive motor 307. The drive gear 306 is engaged with the drive transmission gear 305.

In the discharge drive unit 30, when the drive motor 307 rotates, the rotational force of the drive motor 307 is transmitted to the drive shaft 303 via the drive gear 306 and the drive transmission gear 305, and the drive shaft 303 rotates. When the drive shaft 303 rotates, the rotational force is transmitted to the drive transmission shaft 301 via the second drive transmission belt 304. When the drive transmission shaft 301 rotates, the rotational force is transmitted to the rotation shaft 311 of the lower discharge roller 31 via the first drive transmission belt 302. In this way, the two lower discharge rollers 31 are simultaneously driven to rotate. The rotation of the lower discharge roller 31, i.e. the operation of the discharge drive unit 30 is controlled by the post-processing control unit 207.

The four paddle members 5 are simultaneously driven to rotate by the paddle drive unit 50. As illustrated in FIG. 3, the paddle drive unit 50 includes a first drive transmission shaft 501, a first drive transmission belt 502, a second drive transmission shaft 503, a second drive transmission belt 504, a drive shaft 505, a third drive transmission belt 506, a drive transmission gear 507, a drive gear 508, and a drive motor 509.

There are disposed four first drive transmission belts 502 corresponding to four paddle members 5. There are disposed two sets of the first drive transmission shaft 501, the second drive transmission shaft 503, the second drive transmission belt 504 and the third drive transmission belt 506 corresponding to the two rotation shafts 311 of the two lower discharge rollers 31. There is disposed one set of the drive shaft 505, the drive transmission gear 507, the drive gear 508, and the drive motor 509.

As illustrated in FIG. 4, the paddle member 5 includes a paddle main body 51 and a shaft 52. The shaft 52 is fixed to a side of the paddle main body 51 in the sheet width direction. Each of the paddle main body 51 and the shaft 52 has a cylindrical shape having the center axis extending in the sheet width direction, which is the same as the axis of the rotation shaft 311. A diameter of the paddle main body 51 is smaller than a diameter of the lower discharge roller 31. A diameter of the shaft 52 is smaller than the diameter of the paddle main body 51. The rotation shaft 311 penetrates diameter centers of the paddle main body 51 and the shaft 52 in the sheet width direction. The paddle main body 51 and the shaft 52 can rotate independently of the rotation shaft 311.

The first drive transmission shaft 501 is disposed below the rotation shaft 311 of the lower discharge roller 31. The first drive transmission shaft 501 extends in the sheet width direction.

The first drive transmission belt 502 is stretched over pulleys of the shaft 52 of the paddle member 5 and the first drive transmission shaft 501. Describing in detail, the two first drive transmission belts 502 are stretched over the single first drive transmission shaft 501, and each of the first drive transmission belts 502 is stretched over each of the shafts 52 of the separate paddle members 5. The first drive transmission belt 502 transmits a rotational force of the first drive transmission shaft 501 to the shaft 52 of the paddle member 5.

The second drive transmission shaft 503 is disposed below the first drive transmission shaft 501. The second drive transmission shaft 503 extends in the sheet width direction.

The second drive transmission belt 504 is stretched over pulleys of the first drive transmission shaft 501 and the second drive transmission shaft 503. The second drive transmission belt 504 transmits a rotational force of the second drive transmission shaft 503 to the first drive transmission shaft 501.

The drive shaft 505 is disposed below the second drive transmission shaft 503. The drive shaft 505 extends in the sheet width direction.

The third drive transmission belt 506 is stretched over pulleys of the second drive transmission shaft 503 and the drive shaft 505. Describing in detail, the two third drive transmission belts 506 are stretched over the single drive shaft 505, and each of the third drive transmission belts 506 is stretched over each of the separate second drive transmission shafts 503. The third drive transmission belt 506 transmits a rotational force of the drive shaft 505 to the second drive transmission shaft 503.

The drive transmission gear 507 is provided to the drive shaft 505. The drive transmission gear 507 is disposed coaxially to the drive shaft 505 and rotates together with the drive shaft 505.

The drive gear 508 is provided to the rotation shaft of the drive motor 509. The drive gear 508 is rotated by the drive motor 509. The drive gear 508 is engaged with the drive transmission gear 507.

In the paddle drive unit 50, when the drive motor 509 rotates, the rotational force of the drive motor 509 is transmitted to the drive shaft 505 via the drive gear 508 and the drive transmission gear 507, and the drive shaft 505 rotates. When the drive shaft 505 rotates, the rotational force is transmitted to the second drive transmission shaft 503 via the third drive transmission belt 506. When the second drive transmission shaft 503 rotates, the rotational force is transmitted to the first drive transmission shaft 501 via the second drive transmission belt 504. When the first drive transmission shaft 501 rotates, the rotational force is transmitted to the shaft 52 of the paddle member 5 via the first drive transmission belt 502. In this way, the four paddle members 5 are simultaneously driven to rotate, and they can rotate about the rotation axis of the lower discharge roller 31 independently of the lower discharge roller 31. The rotation of the paddle members 5, i.e. the operation of the paddle drive unit 50 is controlled by the post-processing control unit 207.

As illustrated in FIG. 4, the paddle member 5 includes the paddle main body 51 and a paddle elastic part 53. The paddle main body 51 includes a base part 511 in which the rotation shaft is inserted and an arm part 512 provided to an outer circumferential surface of the base part 511.

The arm part 512 protrudes in a direction crossing the rotation axis of the base part 511 and separating from an axis center. Describing in detail, the arm part 512 protrudes from the outer circumferential surface of the base part 511 outward substantially in a tangential direction of the outer circumferential surface. The arm part 512 is formed integrally to the base part 511. The arm part 512 is made of a material having a higher modulus of rigidity than the paddle elastic part 53.

The paddle elastic part 53 protrudes longer than the arm part 512 in the direction crossing the rotation axis of the paddle main body 51 and separating from the axis center. Describing in detail, the paddle elastic part 53 is attached to the arm part 512 and protrudes longer than the arm part 512 in the same direction as the extending direction of the arm part 512. The paddle elastic part 53 is made of a material such as rubber having a higher modulus of elasticity than the arm part 512 (paddle main body 51).

Next, an operation of the sheet stacking device 1 is described with reference to FIGS. 5 to 8. FIGS. 5 to 8 are explanatory diagrams (1) to (4) illustrating a sheet stacking operation by the sheet stacking device 1.

Figure 5:
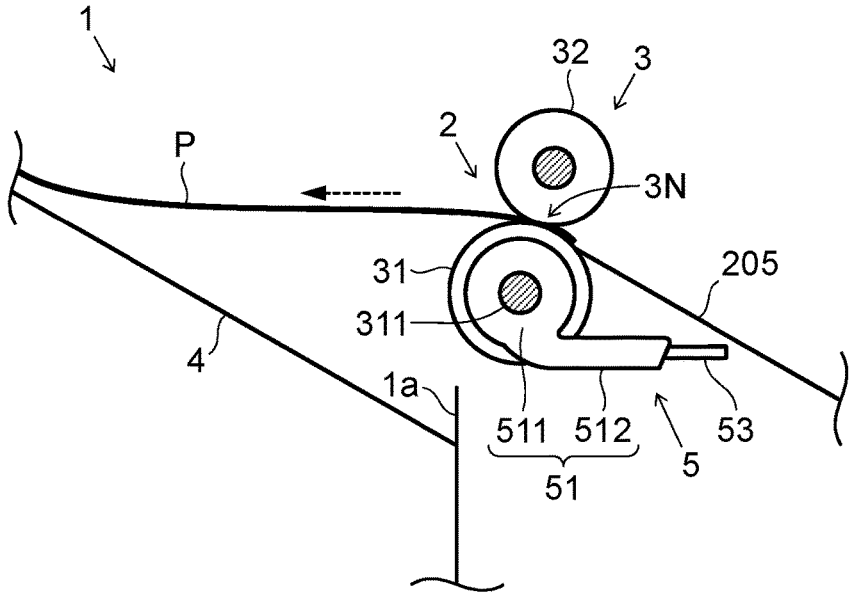
FIG. 5 is an explanatory diagram (1) illustrating a sheet stacking operation by the sheet stacking device according to the first embodiment of the present disclosure.

As illustrated in FIG. 5, before the paddle member 5 begins its operation, its rotation is stopped in a state where the arm part 512 and the paddle elastic part 53 are in a retracting position without protruding to either the process tray 205 side or the stacking tray 4 side. In other words, the paddle member 5 waits at a predetermined position. In this way, when the paddle member 5 is not used, it does not become an obstacle to discharging of the sheet P. A rotation speed of the discharge roller pair 3 is decreased before the sheet P passes through the nip 3N of the discharge roller pair 3. In other words, a discharging speed of the sheet P that is discharged through the sheet outlet 2 by the discharge roller pair 3 is decreased to a predetermined speed before the upstream end of the sheet P in the sheet discharging direction passes through the nip 3N of the discharge roller pair 3.

Figure 6:
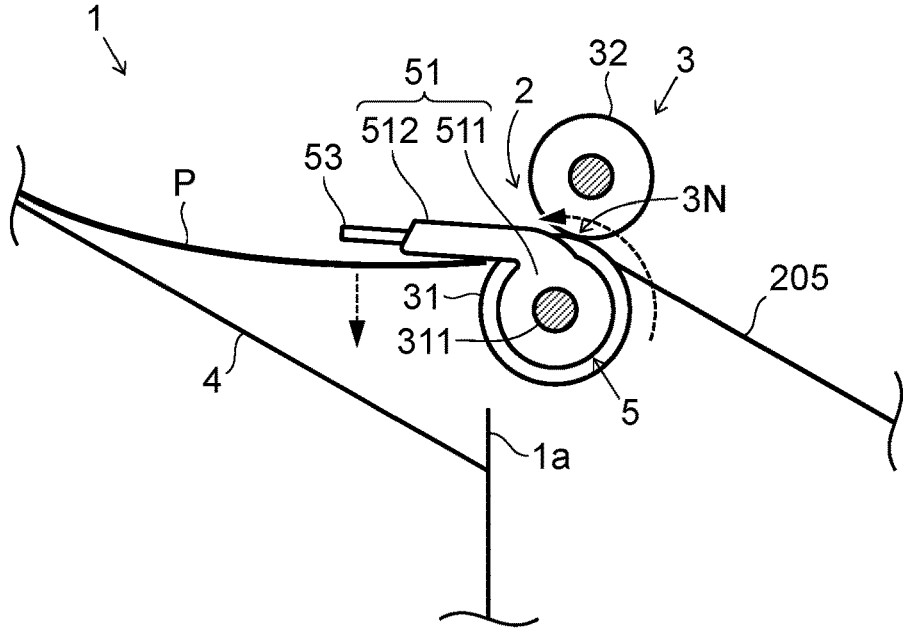
FIG. 6 is an explanatory diagram (2) illustrating the sheet stacking operation by the sheet stacking device according to the first embodiment of the present disclosure.

Next, as illustrated in FIG. 6, before the sheet P discharged through the sheet outlet 2 passes through the nip 3N of the discharge roller pair 3, and before the sheet P is stacked on the stacking tray 4, the paddle drive unit 50 begins rotation of the paddle member 5. A rotation speed of the paddle member 5 is the same as the rotation speed of the discharge roller pair 3 when the sheet P passes through the nip 3N of the discharge roller pair 3.

The paddle member 5 contacts the upstream part in the discharging direction of the sheet P discharged through the sheet outlet 2 by the discharge roller pair 3. In this way, the paddle member 5 presses the upstream part in the discharging direction of the sheet P discharged through the sheet outlet 2, down to the stacking tray 4 by tapping the same from above.

Figure 7:
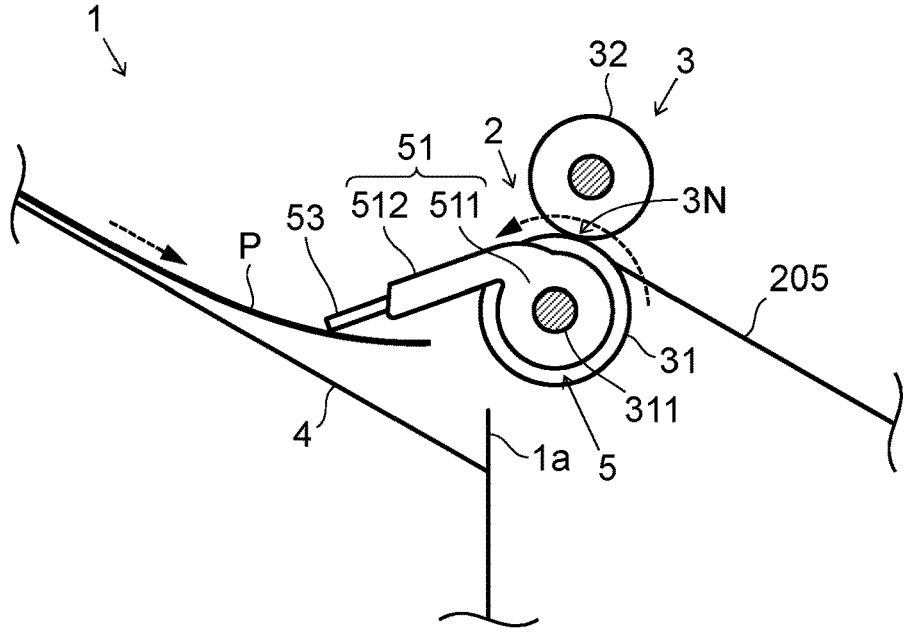
FIG. 7 is an explanatory diagram (3) illustrating the sheet stacking operation by the sheet stacking device according to the first embodiment of the present disclosure.

Next, as the rotation of the paddle member 5 proceeds, the paddle elastic part 53 contacts the upstream part in the discharging direction of the sheet P discharged through the sheet outlet 2, as illustrated in FIG. 7. In this way, the paddle member 5 pulls in the sheet P along the stacking tray 4 to the upstream side in the discharging direction of the sheet P. Further, the paddle member 5 presses the upstream part of the sheet P in the discharging direction to the stacking tray 4.

Figure 8:
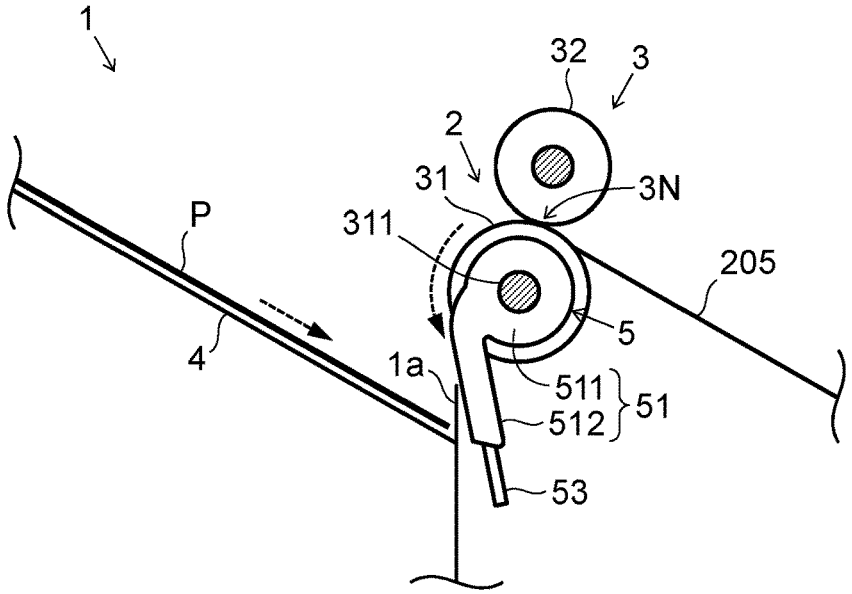
FIG. 8 is an explanatory diagram (4) illustrating the sheet stacking operation by the sheet stacking device according to the first embodiment of the present disclosure.

When the sheet stacking operation by the sheet stacking device 1 is finished, the upstream end of the sheet P in the discharging direction contacts the sheet receiving wall 1*a* disposed on the upstream side of the stacking tray 4 in the sheet discharging direction, as illustrated in FIG. 8. In this way, the sheets P are aligned at a predetermined position on the stacking tray 4. Note that the sheet receiving wall 1*a* has a slit (not shown) in the rotation track of the paddle member 5, so that the paddle member 5 can pass through the slit. In this way, the arm part 512 and the paddle elastic part 53 reaches the retracting position without protruding to the stacking tray 4 side.

With the structure described above, the rotation speed of the paddle member 5 is the same as the rotation speed of the discharge roller pair 3 when the sheet P passes through the nip 3N of the discharge roller pair 3, and hence the timing when the sheet P is discharged through the sheet outlet 2 by the discharge roller pair 3 and the timing when the paddle member 5 contacts the upstream part of the sheet P in the discharging direction can be adjusted to an appropriate timing. In this way, it is possible to suppress a deflection in the upstream part in the discharging direction of the sheet P discharged through the sheet outlet 2, though the deflection may occur if the rotation speed of the paddle member 5 is different from the rotation speed of the discharge roller pair 3 when the sheet P passes through the nip 3N of the discharge roller pair 3. Therefore, the sheet P having no deflection can be stacked on the stacking tray 4. In this way, the sheets P on the stacking tray 4 can be appropriately aligned.

Figure 9:
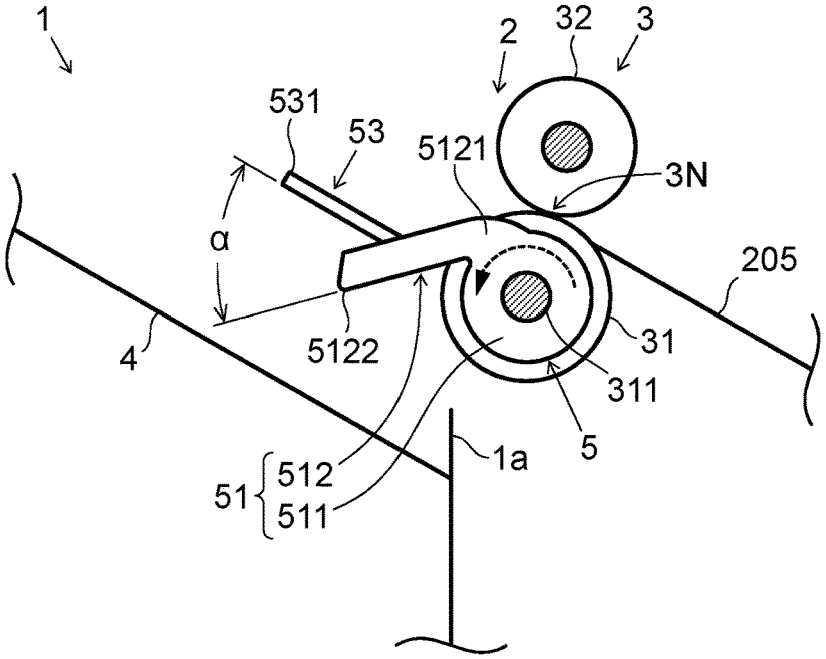
FIG. 9 is a cross-sectional front view illustrating a schematic structure of the sheet stacking device according to a second embodiment of the present disclosure.

Next, the sheet stacking device 1 of a second embodiment is described. FIG. 9 is a cross-sectional front view illustrating a schematic structure of the sheet stacking device 1 of the second embodiment. Note that a basic structure of this second embodiment is the same as that of the first embodiment described above, and hence the same structural element is denoted by the same numeral or the same name, so that description thereof may be omitted, and description of a part other than a characteristic part is omitted.

As illustrated in FIG. 9, the sheet stacking device 1 of the second embodiment includes the paddle member 5. The paddle member 5 includes the paddle main body 51 and the paddle elastic part 53. The paddle main body 51 includes the base part 511 and the arm part 512.

The paddle elastic part 53 is attached to the arm part 512 and protrudes longer than the arm part 512 in a direction different from the extending direction of the arm part 512. Describing in detail, the paddle elastic part 53 protrudes from an intermediate part between a proximal portion 5121 of the arm part 512 to the outer circumferential surface of the base part 511 and a distal end portion 5122 in a protruding direction thereof, in a direction different from the extending direction of the arm part 512.

The distal end part 531 of the paddle elastic part 53 in the protruding direction protrudes at a predetermined angle on the upstream side in the rotation direction of the paddle member 5 with respect to the arm part 512, so that it is positioned on the upstream side in the rotation direction of the paddle member 5 from the distal end part 5122 of the arm part 512 in the protruding direction. In other words, the arm part 512 and the paddle elastic part 53 are formed to have different positional phases in the rotation direction of the paddle member 5.

For instance, if the paddle elastic part 53 extends in the same direction as the arm part 512 similarly to the first embodiment, the paddle elastic part 53 may contact the sheet P before the arm part 512 contacts the sheet P. If any one of the paddle elastic parts 53 of the four paddle members 5 contacts the sheet P discharged through the sheet outlet 2 before the arm part 512 contacts the sheet P, when the sheet P is pressed to near the sheet stacking surface of the stacking tray 4, the pressing condition of the sheet P in the width direction may vary, resulting in a deflection in the upstream part of the sheet P in the discharging direction.

However, with the structure of the second embodiment described above, the distal end part 531 of the paddle elastic part 53 is positioned on the upstream side in the rotation direction of the paddle member 5 from the distal end part 5122 of the arm part 512, and hence it is possible to prevent the paddle elastic part 53 from contacting the sheet P before the arm part 512 contacts the sheet P. In this way, it is possible to prevent a deflection in the upstream part in the discharging direction of the sheet P discharged through the sheet outlet 2, which may occur if the paddle elastic part 53 extends in the same direction as the arm part 512.

Note that an angle $\alpha$ between the extending direction of the arm part 512 and the extending direction of the paddle elastic part 53 is preferably 45 degrees. In this way, it is possible to prevent the paddle elastic part 53 of any one of the paddle members 5 from contacting the sheet P before the arm part 512 contacts the sheet P. Thus, all the paddle members 5 can contact the upstream part of the sheet P in the discharging direction at the same timing.

Figure 10:
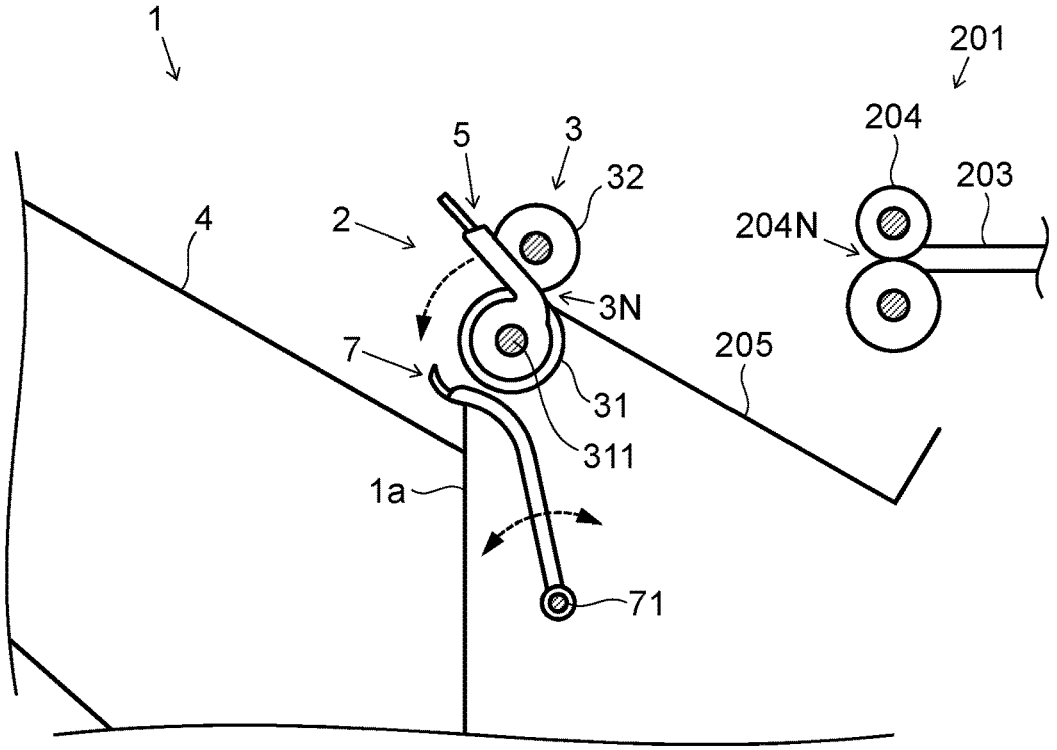
FIG. 10 is a cross-sectional front view illustrating a schematic structure of the sheet stacking device according to a third embodiment of the present disclosure.
Figure 11:
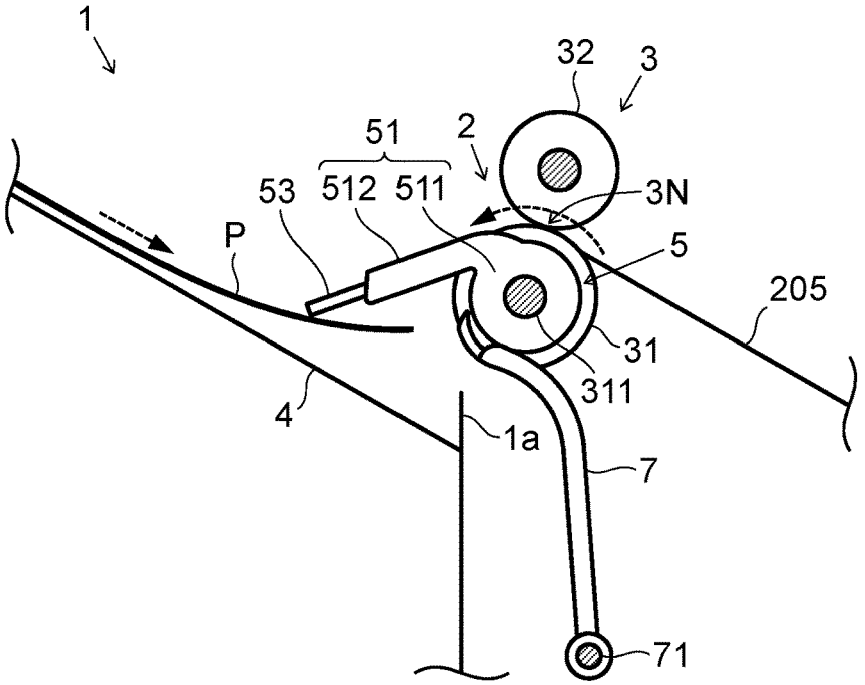
FIG. 11 is an explanatory diagram (1) illustrating the sheet stacking operation by the sheet stacking device according to the third embodiment of the present disclosure.
Figure 12:
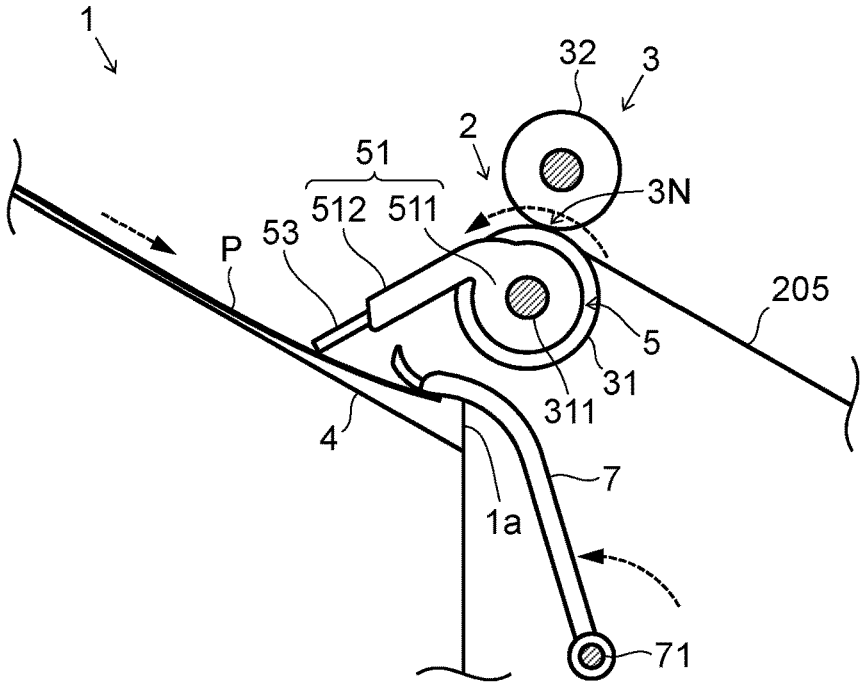
FIG. 12 is an explanatory diagram (2) illustrating the sheet stacking operation by the sheet stacking device according to the third embodiment of the present disclosure.
Figure 13:
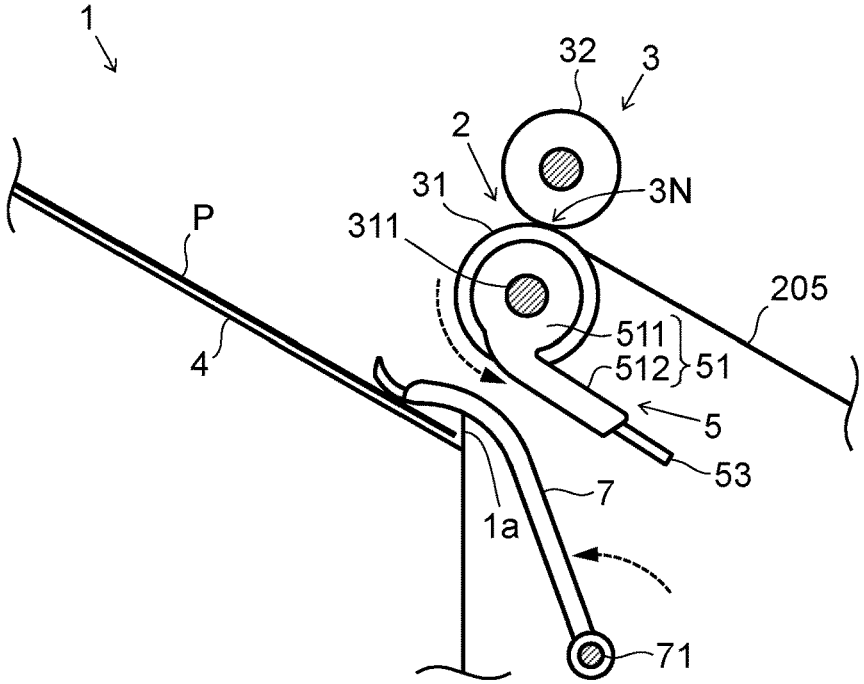
FIG. 13 is an explanatory diagram (3) illustrating the sheet stacking operation by the sheet stacking device according to the third embodiment of the present disclosure.

Next, the sheet stacking device 1 of a third embodiment is described. FIG. 10 is a cross-sectional front view illustrating a schematic structure of the sheet stacking device 1 of the third embodiment. FIGS. 11 to 13 are explanatory diagrams (1) to (3) illustrating the sheet stacking operation by the sheet stacking device 1 of the third embodiment. Note that a basic structure of this third embodiment is the same as that of the first embodiment described above, and hence the same structural element is denoted by the same numeral or the same name, so that description thereof may be omitted, and description of a part other than a characteristic part is omitted.

As illustrated in FIG. 10, the sheet stacking device 1 of the third embodiment includes a sheet pressing member 7.

The sheet pressing member 7 is disposed on the upstream side of the stacking tray 4 in the sheet discharging direction. The sheet pressing member 7 is disposed below the rotation shaft 311 of the lower discharge roller 31. In this embodiment, for example, two sheet pressing members 7 are disposed with a predetermined space in the sheet width direction, in the middle part of the stacking tray 4 in the sheet width direction. Note that the sheet pressing members 7 are disposed at positions different from those of the paddle members 5 in the sheet width direction.

The sheet pressing member 7 is a rod-like member that has a predetermined width in the sheet width direction and extends substantially in the up and down direction. The sheet pressing member 7 is supported by the sheet stacking device 1 at the lower end in a rotatable manner about a rotation shaft 71 extending in the sheet width direction. The sheet pressing member 7 is connected to a drive unit (not shown) and is rocked at the upper end as a free end in the sheet discharging direction about the rotation shaft 71 by the drive unit.

As illustrated in FIG. 11, before the sheet pressing member 7 begins its operation, the rocking thereof is stopped at a retracting position without protruding to the stacking tray 4 side, i.e. a press release position for releasing pressing the sheet P stacked on the stacking tray 4. In this way, when the sheet pressing member 7 is not used, it separates from the sheet P stacked on the stacking tray 4 so as not to be an obstacle to discharging of the sheet P.

Next, as illustrated in FIG. 12, the paddle member 5 is rotated, and before the paddle member 5 passes the upstream end of the stacking tray 4 in the sheet discharging direction, the rocking of the sheet pressing member 7 begins. Then, as illustrated in FIG. 13, the sheet pressing member 7 moves to a press position for pressing downward the upstream part in the discharging direction of the sheet P stacked on the stacking tray 4.

As described above, in the sheet stacking device 1 of the third embodiment, the sheet pressing member 7 moves between the press position (see FIG. 13) for pressing downward the upstream part in the discharging direction of the sheet P stacked on the stacking tray 4 and the press release position (see FIG. 11) for separating from the sheet P so as to release pressing the sheet P.

With this structure, a curled sheet P can be pressed from above by the sheet pressing member 7. In this way, it is possible to support a case where speed of discharging the sheets P and stacking the same on the stacking tray 4 is increased, and it becomes possible to press downward the upstream part in the discharging direction of the sheets P stacked on the stacking tray 4 and appropriately align the sheets P on the stacking tray 4.

Figure 14:
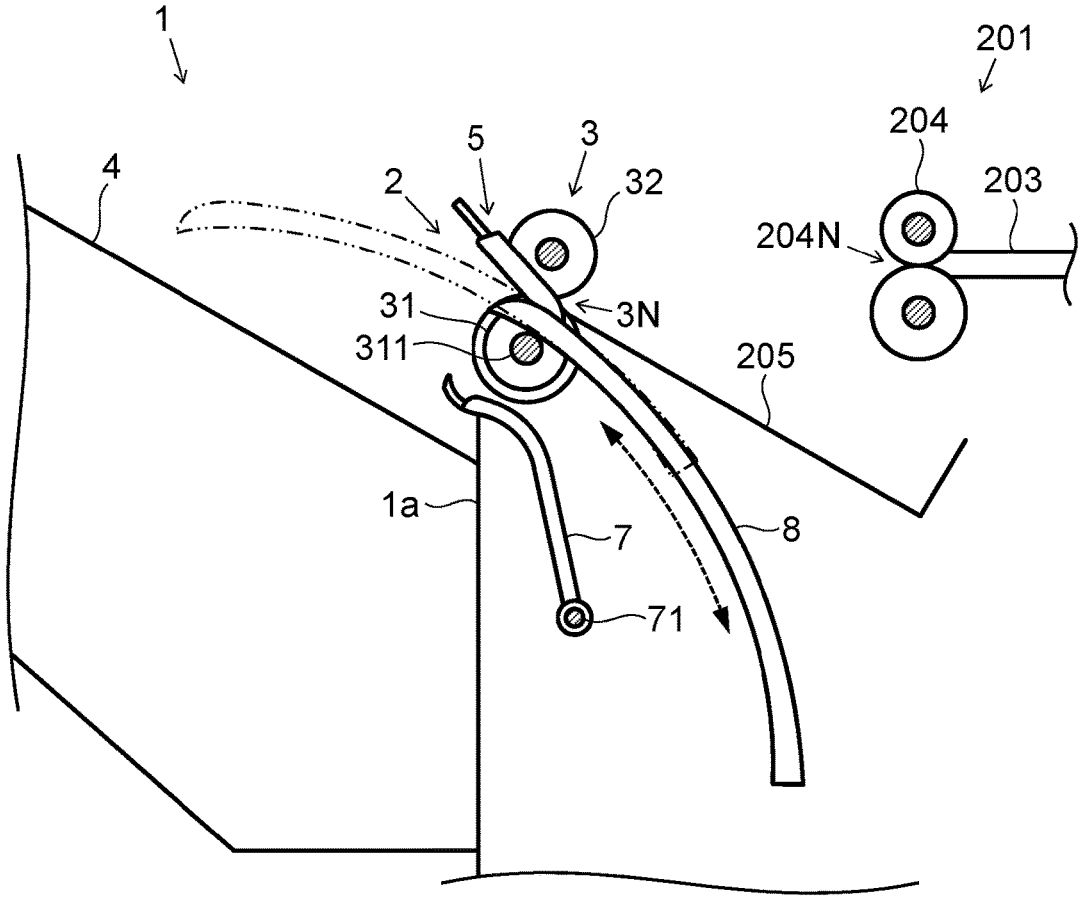
FIG. 14 is a cross-sectional front view illustrating a schematic structure of the sheet stacking device according to a fourth embodiment of the present disclosure.
Figure 15:
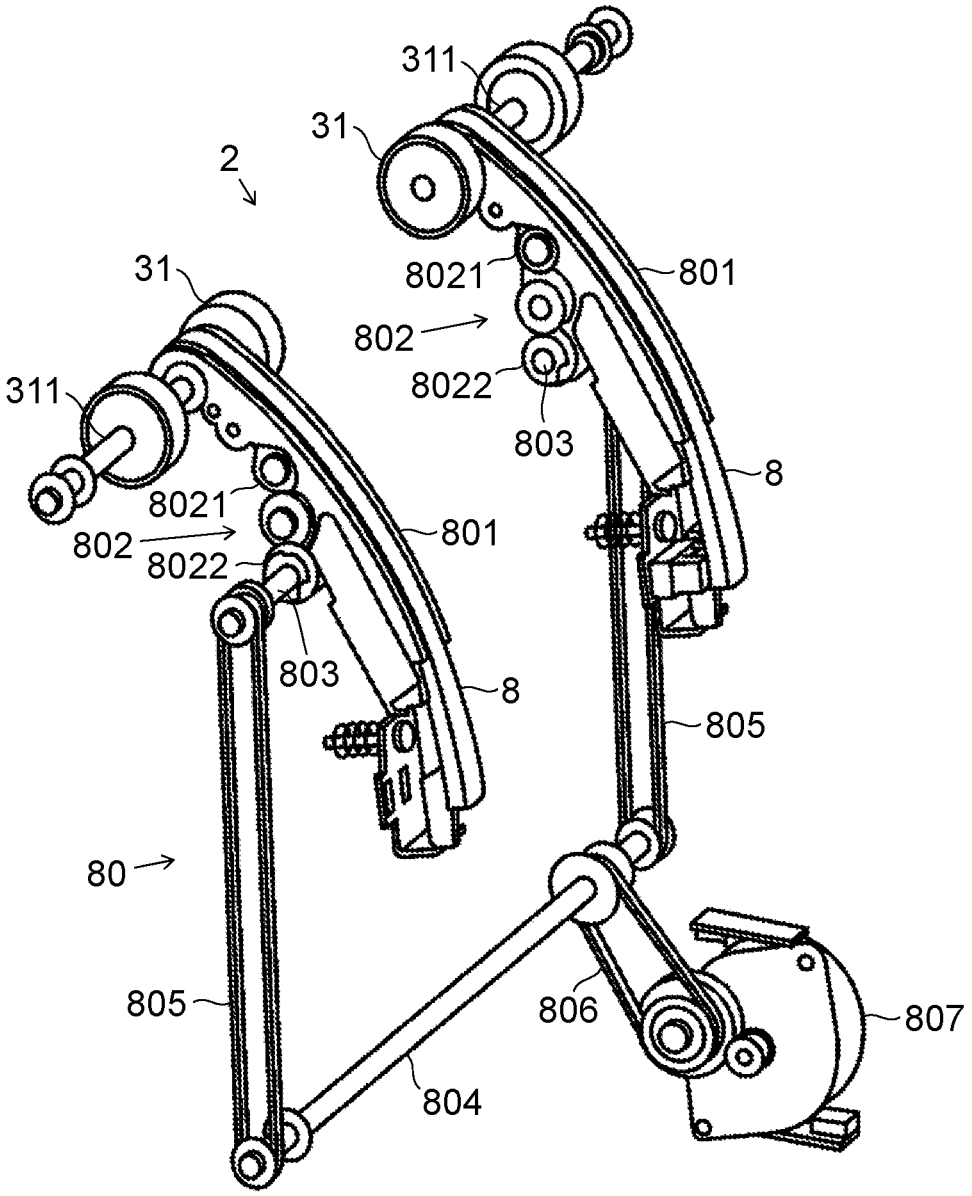
FIG. 15 is a perspective view illustrating a state in which a protruding member of the sheet stacking device is in a retracting position according to the fourth embodiment of the present disclosure.
Figure 16:
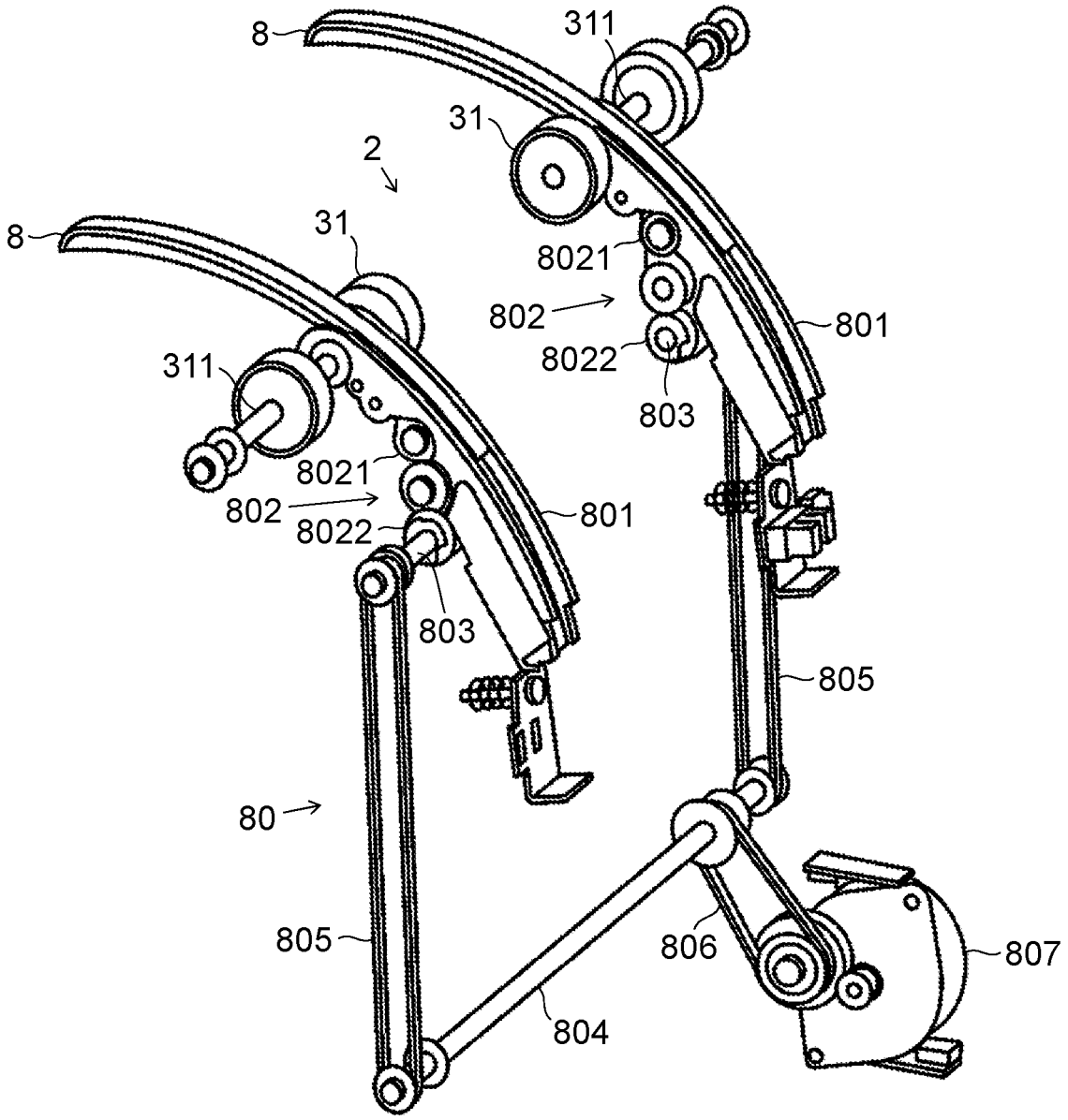
FIG. 16 is a perspective view illustrating a state in which the protruding member of the sheet stacking device is in a protruding position according to the fourth embodiment of the present disclosure.
Figure 17:
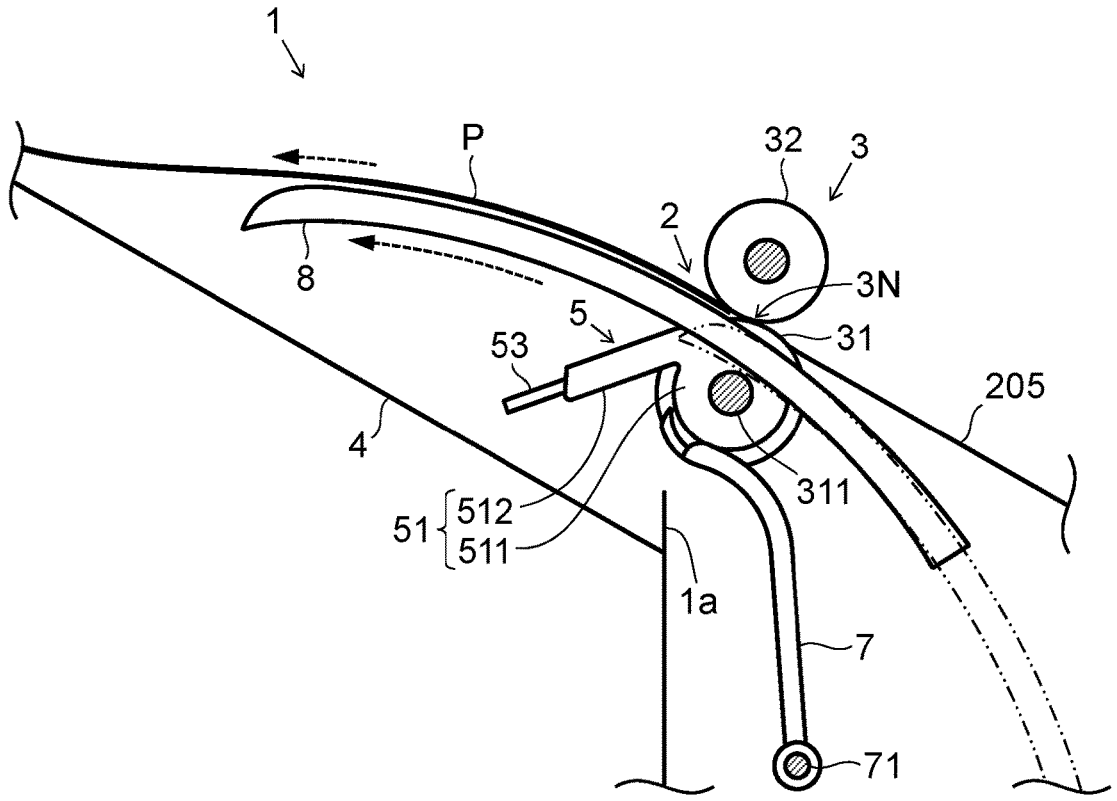
FIG. 17 is a cross-sectional front view illustrating a state in which the protruding member of the sheet stacking device is in the protruding position according to the fourth embodiment of the present disclosure.

Next, the sheet stacking device 1 of a fourth embodiment is described. FIG. 14 is a cross-sectional front view illustrating a schematic structure of the sheet stacking device 1 of the fourth embodiment. FIG. 15 is a perspective view illustrating a state in which a protruding member 8 of the sheet stacking device 1 of the fourth embodiment is in a retracting position. FIG. 16 is a perspective view illustrating a state in which the protruding member 8 of the sheet stacking device 1 of the fourth embodiment is in a protruding position. FIG. 17 is a cross-sectional front view illustrating a state in which the protruding member 8 of the sheet stacking device 1 of the fourth embodiment is in the protruding position. Note that a basic structure of this fourth embodiment is the same as that of the first or third embodiment described above, and hence the same structural element is denoted by the same numeral or the same name, so that description thereof may be omitted, and description of a part other than a characteristic part is omitted.

The sheet stacking device 1 of the fourth embodiment includes the protruding member 8 as illustrated in FIG. 14.

The protruding member 8 is disposed below the sheet outlet 2. Describing in detail, the protruding member 8 is disposed below the sheet outlet 2 and the process tray 205, and below the discharging path of the sheet P discharged through the sheet outlet 2 onto the process tray 205. In this embodiment, for example, two protruding members 8 are disposed with a predetermined space in the sheet width direction, in the middle part of the stacking tray 4 in the sheet width direction. Note that the protruding members 8 are disposed at positions different from those of the paddle members 5 in the sheet width direction.

The protruding member 8 is a rod-like member that has a predetermined width in the sheet width direction and extends in an arc-shaped manner in the sheet discharging direction. The protruding member 8 is supported by a protrusion drive unit 80 illustrated in FIGS. 15 and 16, and is moved by the protrusion drive unit 80 in the sheet discharging direction.

As illustrated in FIGS. 15 and 16, the protrusion drive unit 80 includes a guide rail 801, a drive transmission gear group 802, a drive transmission shaft 803, a drive shaft 804, a drive transmission belt 805, a drive belt 806, and a drive motor 807.

There are disposed two sets of the guide rail 801, the drive transmission gear group 802, the drive transmission shaft 803 and the drive transmission belt 805, corresponding to the two protruding members 8. There is disposed one set of the drive shaft 804, the drive belt 806, and the drive motor 807.

The guide rail 801 is disposed on the upstream side of the sheet outlet 2 in the sheet discharging direction. The guide rail 801 is a gutter-shaped member that opens upward and extends in an arc-shaped manner in the sheet discharging direction similarly to the protruding member 8. The guide rail 801 houses and supports the protruding member 8 inside.

The drive transmission gear group 802 is disposed below the guide rail 801. The drive transmission gear group 802 is constituted of a plurality of gears that are engaged with each other, including a pinion gear 8021 at an end of the guide rail 801 side and a drive transmission gear 8022 at an end of the drive transmission shaft 803 side.

The pinion gear 8021 is disposed immediately below the guide rail 801. A rack (not shown) is formed on the lower surface side of the protruding member 8 so as to constitute a rack and pinion mechanism. The rack has a plurality of teeth arranged in the sheet discharging direction. The pinion gear 8012 is engaged with the rack of the protruding member 8. Note that the guide rail 801 has a window (not shown) at the part adjacent to the pinion gear 8021, so that the pinion gear 8021 and the rack of the protruding member 8 can engage with each other.

The drive transmission shaft 803 is disposed below the drive transmission gear group 802. The drive transmission shaft 803 extends in the sheet width direction. The drive transmission gear 8022 of the drive transmission gear group 802 is disposed coaxially to the drive transmission shaft 803 and rotates together with the drive transmission shaft 803.

The drive shaft 804 is disposed below the drive transmission shaft 803. The drive shaft 804 extends in the sheet width direction.

The drive transmission belt 805 is stretched over pulleys of the drive transmission shaft 803 and the drive shaft 804. Describing in detail, the two drive transmission belts 805 are stretched over the single drive shaft 804, and each of the drive transmission belts 805 is stretched over each of the separate drive transmission shafts 803. The drive transmission belt 805 transmits a rotational force of the drive shaft 804 to the drive transmission shaft 803.

The drive belt 806 is stretched over pulleys of the drive shaft 804 and the rotation shaft of the drive motor 807. The drive belt 806 is rotated by the drive motor 807.

In the protrusion drive unit 80, when the drive motor 807 rotates, the rotational force of the drive motor 807 is transmitted to the drive shaft 804 via the drive belt 806, and hence the drive shaft 804 rotates. When the drive shaft 804 rotates, the rotational force is transmitted to the drive transmission shaft 803 via the drive transmission belt 805. When the drive transmission shaft 803 rotates, the rotational force is transmitted to the pinion gear 8021 via the drive transmission gear group 802. In this way, the two protruding members 8 are moved simultaneously in the sheet discharging direction. The movement of the protruding members 8, i.e. the operation of the protrusion drive unit 80 is controlled by the post-processing control unit 207.

In the sheet stacking device 1 of the fourth embodiment, the protruding member 8 protrudes from the sheet outlet 2 to the downstream side in the sheet discharging direction, i.e., it protrudes from the sheet outlet 2 to above the stacking tray 4 as illustrated in FIG. 17. The protruding member 8 moves between the protruding position for contacting the lower surface of the sheet P discharged through the sheet outlet 2 by the discharge roller pair 3 (see FIGS. 16 and 17) and a retracting position for retracting from above the stacking tray 4 to the upstream side of the sheet outlet 2 in the sheet discharging direction (see FIGS. 14 and 15).

With this structure, by moving the protruding member 8 to the protruding position, the sheet P discharged through the sheet outlet 2 can be sent to the downstream side in the sheet discharging direction farther from the sheet outlet 2 on the stacking tray 4, compared with a case in which the protruding member 8 is not used. In this way, it is possible to avoid curling of the downstream part of the sheet P in the sheet discharging direction. Therefore, the sheets P on the stacking tray 4 can be aligned more appropriately, and it is also possible to support a case where speed of discharging the sheets P and stacking the same on the stacking tray 4 is increased.

Figure 18:
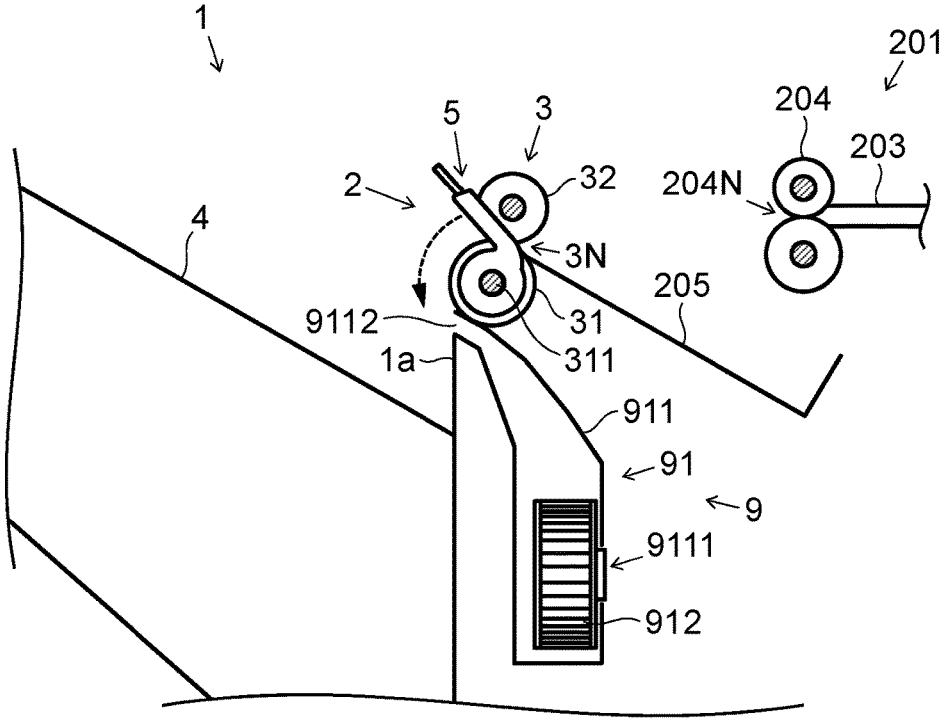
FIG. 18 is a cross-sectional front view illustrating a schematic structure of the sheet stacking device according to a fifth embodiment of the present disclosure.
Figure 19:
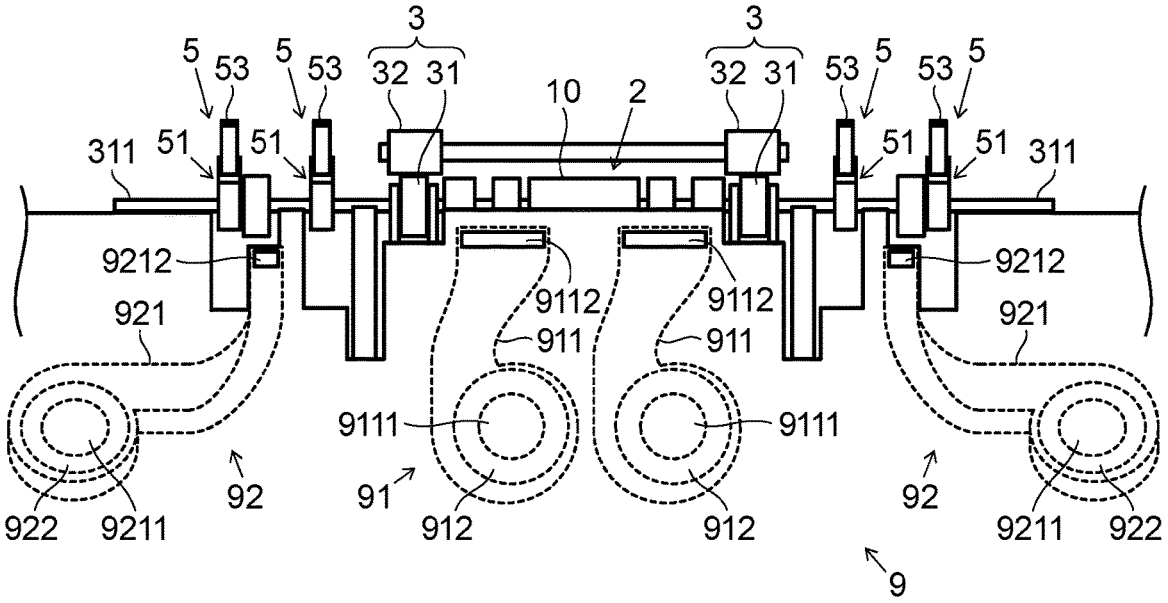
FIG. 19 is a side view of the sheet stacking device according to the fifth embodiment of the present disclosure.

Next, the sheet stacking device 1 of a fifth embodiment is described. FIG. 18 is a cross-sectional front view illustrating a schematic structure of the sheet stacking device 1 of the fifth embodiment. FIG. 19 is a side view of the sheet stacking device 1 of the fifth embodiment. Note that a basic structure of this fifth embodiment is the same as that of the first embodiment described above, and hence the same structural element is denoted by the same numeral or the same name, so that description thereof may be omitted, and description of a part other than a characteristic part is omitted.

As illustrated in FIGS. 18 and 19, the sheet stacking device 1 of the fifth embodiment includes a blower unit 9 and a center guide member 10.

The center guide member 10 is disposed below the center of the sheet outlet 2 in the sheet width direction. The center guide member 10 is disposed at an intermediate part between the two discharge roller pairs 3 in the sheet width direction. The center guide member 10 has a curved surface that curves with substantially the same curvature as the outer circumferential surface of the lower discharge roller 31. The center guide member 10 guides the lower surface of the sheet P that is discharged through the sheet outlet 2 by the two discharge roller pairs 3.

The blower unit 9 is disposed below the center guide member 10. The blower unit 9 includes two first blower units 91 and two second blower units 92.

The two first blower units 91 are disposed side by side in the sheet width direction between the two discharge roller pairs 3 in the sheet width direction. The first blower unit 91 includes a blower duct 911 and a blower fan 912.

The blower duct 911 has an air inlet 9111 and an air outlet 9112 opening on both ends in an air flow direction. The blower fan 912 is disposed at the air inlet 9111. The air outlet 9112 is disposed below the center guide member 10 and is directed to above the downstream side of the sheet outlet 2 in the sheet discharging direction.

The blower fan 912 is disposed adjacent to the air inlet 9111 inside the blower duct 911. The blower fan 912 is constituted of a centrifugal blower such as a sirocco fan. The blower fan 912 makes air flow in the blower duct 911. The first blower unit 91 blows air upward from the air outlet 9112 to the downstream side of the sheet outlet 2 in the sheet discharging direction.

The two second blower units 92 are disposed outside of the two discharge roller pairs 3 in the sheet width direction. The second blower unit 92 includes a blower duct 921 and a blower fan 922.

The blower duct 921 has an air inlet 9211 and an air outlet 9212 opening on both ends in an air flow direction. The blower fan 922 is disposed at the air inlet 9211. The air outlet 9212 is disposed below the center guide member 10 and is directed to above the downstream side of the sheet outlet 2 in the sheet discharging direction.

The blower fan 922 is disposed adjacent to the air inlet 9211 inside the blower duct 921. The blower fan 922 is constituted of a centrifugal blower such as a sirocco fan. The blower fan 922 makes air flow in the blower duct 921. The second blower unit 92 blows air upward from the air outlet 9212 to the downstream side of the sheet outlet 2 in the sheet discharging direction.

The blower unit 9 always operates during the sheet discharging operation onto the stacking tray 4 by the sheet stacking device 1, and air is blown upward from the air outlets 9112 and 9212 to the downstream side of the sheet outlet 2 in the sheet discharging direction.

As illustrated in FIG. 19, in the case where the paddle members 5 are disposed outside the two discharge roller pairs 3 in the sheet width direction, the sheet P dropping from the sheet outlet 2 onto the stacking tray 4 may be a state where its middle part in the sheet width direction warps upward from the outsides in the sheet width direction at which the paddle members 5 are disposed. Then, the middle part of the sheet P in the sheet width direction warping upward may touch the center guide member 10 when the sheet P drops. This phenomenon causes concern that the sheets P on the stacking tray 4 may not be aligned appropriately.

Regarding this concern, with the structure of the fifth embodiment described above, the sheet stacking device 1 includes the air outlets 9112 and 9212 disposed below the center guide member 10, and the blower unit 9 is disposed, which blows air from the air outlets 9112 and 9212 to above the downstream side of the sheet outlet 2 in the sheet discharging direction. Therefore, it is possible to blow air from below to the sheet P discharged through the sheet outlet 2. In this way, it is possible to prevent the middle part of the sheet P in the sheet width direction from touching the center guide member 10. In this way, the sheets P on the stacking tray 4 can be appropriately aligned.

In addition, according to the embodiments described above, the sheet post-processing device 201 includes the sheet stacking device 1 having the above-described structure. Therefore, in the sheet post-processing device 201, when the sheet P is discharged onto the stacking tray 4, the timing when the sheet P is discharged through the sheet outlet 2 by the discharge roller pair 3 and the timing when the paddle member 5 contacts the upstream part of the sheet P in the discharging direction can be adjusted to an appropriate timing. Therefore, in the sheet post-processing device 201, the sheets P on the stacking tray 4 can be appropriately aligned.

Further, according to the embodiments described above, the image forming system S includes the sheet stacking device 1 having the above-described structure. Therefore, in the image forming system S, when the sheet P is discharged onto the stacking tray 4, the timing when the sheet P is discharged through the sheet outlet 2 by the discharge roller pair 3 and the timing when the paddle member 5 contacts the upstream part of the sheet P in the discharging direction can be adjusted to an appropriate timing. Therefore, in the image forming system S, the sheets P on the stacking tray 4 can be appropriately aligned.

Although the embodiments of the present disclosure are described above, the scope of the present disclosure is not limited to the embodiments, but can be variously modified and implicated within the scope of the invention without deviating from the spirit thereof.

For instance, the image forming apparatus 101 of the image forming system S is the image forming apparatus for monochrome printing in the embodiments described above, but this is not a limitation. The image forming apparatus may be an image forming apparatus for color printing, for example.

What is claimed is:

1. A sheet stacking device comprising:

at least one discharge roller pair including a lower discharge roller and an upper discharge roller, whose circumferential surfaces contact each other to form a nip, so as to discharge a sheet in a predetermined discharging direction;

a sheet outlet in which the discharge roller pair is disposed;

a stacking tray disposed below a downstream side of the sheet outlet in a sheet discharging direction, so that the sheet discharged through the sheet outlet by the discharge roller pair is stacked on the stacking tray; and a paddle member disposed coaxially to a rotation shaft of the lower discharge roller, the paddle member being driven to rotate about an axis of the rotation shaft of the lower discharge roller independently of the lower discharge roller in the same direction as the lower discharge roller, so as to contact the sheet discharged through the sheet outlet at an upstream part in the discharging direction from above, wherein the paddle member includes a base part in which the rotation shaft is inserted, an arm part protruding from the base part in a direction crossing the axis and separating from an axis center, and a paddle elastic part attached to the arm part so as to protrude from the arm part, a rotation speed of the discharge roller pair is decreased before the sheet passes through the nip of the discharge roller pair, the paddle member waits at a predetermined position and starts to rotate before the sheet passes through the nip of the discharge roller pair so that the sheet is stacked on the stacking tray, and a rotation speed of the paddle member is the same as the rotation speed of the discharge roller pair when the sheet passes through the nip of the discharge roller pair.

2. The sheet stacking device according to claim 1, wherein the paddle elastic part protrudes at a predetermined angle with respect to the arm part on an upstream side in a rotation direction of the paddle member, so that a distal end of the paddle elastic part is positioned on the upstream side of a distal end of the arm part in the rotation direction of the paddle member.

3. The sheet stacking device according to claim 1, further comprising a sheet pressing member disposed below the discharge roller pair on the upstream side of the stacking tray in the sheet discharging direction, so as to move between a press position for pressing downward the upstream part in the discharging direction of the sheet stacked on the stacking tray and a press release position for separating from the sheet to release pressing the sheet.

4. The sheet stacking device according to claim 1, further comprising a protruding member configured to move between a protruding position for protruding from the sheet outlet to above the stacking tray so as to contact a lower surface of the sheet discharged through the sheet outlet by the discharge roller pair and a retracting position for retracting from above the stacking tray.

5. The sheet stacking device according to claim 1, wherein:

the at least one discharge roller pair includes two discharge roller pairs disposed below a middle part of the sheet outlet in a sheet width direction crossing the sheet discharging direction;

a sheet receiving wall extending upward from an upstream side end of the stacking tray in the sheet discharging direction to the sheet outlet;

a center guide member disposed between the two discharge roller pairs so as to guide a lower surface of the sheet discharged through the sheet outlet by the two discharge roller pairs; and a blower unit having an air outlet disposed below the center guide member in the sheet receiving wall, so as to blow air upward from the air outlet to the downstream side in the sheet discharging direction.

6. A sheet post-processing device comprising:

a process tray for stacking sheets;

a post-processing unit for performing a predetermined post-processing on the sheets stacked on the process tray; and the sheet stacking device according to claim 1, including the discharge roller pair disposed on the downstream side of the process tray in the sheet discharging direction, so as to stack the sheets to which the post-processing has been applied by the post-processing unit, on the stacking tray by the discharge roller pair.

7. An image forming system comprising:

an image forming apparatus for forming an image on a sheet; and the sheet post-processing device according to claim 6, connected to the image forming apparatus, so as to perform the post-processing on the sheet on which the image has been formed.

* * * * *